US011753233B2

(12) United States Patent
Kim et al.

(10) Patent No.: US 11,753,233 B2
(45) Date of Patent: Sep. 12, 2023

(54) CONTAINER FOR DISCHARGING DIFFERENT TYPES OF CONTENT

(71) Applicant: SAMHWA CO., LTD, Uiwang-si (KR)

(72) Inventors: Chang Gon Kim, Hwaseong-si (KR); Ki Sung Lee, Suwon-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 127 days.

(21) Appl. No.: 17/442,625

(22) PCT Filed: Dec. 11, 2019

(86) PCT No.: PCT/KR2019/017439
§ 371 (c)(1),
(2) Date: Sep. 24, 2021

(87) PCT Pub. No.: WO2020/218703
PCT Pub. Date: Oct. 29, 2020

(65) Prior Publication Data

US 2022/0169433 A1 Jun. 2, 2022

(30) Foreign Application Priority Data

Apr. 26, 2019 (KR) ..... 10-2019-0048812

(51) Int. Cl.
*B65D 81/32* (2006.01)
*A45D 40/24* (2006.01)
(Continued)

(52) U.S. Cl.
CPC ..... *B65D 81/3227* (2013.01); *A45D 40/24* (2013.01); *B05B 11/028* (2023.01);
(Continued)

(58) Field of Classification Search
CPC ..... B05B 11/1084; B05B 11/1028; B05B 11/1074; B65D 81/325; B65D 81/3227;
(Continued)

(56) References Cited

U.S. PATENT DOCUMENTS 4,355,739 A * 10/1982 Vierkotter ..... B05B 11/1081 222/134
4,826,048 A * 5/1989 Skorka ..... B05B 11/1084 222/137

(Continued)

FOREIGN PATENT DOCUMENTS

KR 20-2014-0003301 U 6/2014
KR 20-0477046 Y1 5/2015

(Continued)

OTHER PUBLICATIONS

International Search Report in International Application No. PCT/KR2019/017439, dated Oct. 27, 2020, 4pages.

*Primary Examiner* — Patrick M. Buechner

(74) *Attorney, Agent, or Firm* — PARK, KIM & SUH, LLC

(57) ABSTRACT

A dispensing container for discharging different types of contents includes a first container, a second container, a first pump module coupled to the first container, and a second pump module coupled to the second container. The first container includes an insertion space and a first interior space separated from the insertion space by a partition wall. The second container is inserted into the insertion space and includes a second interior space. The first pump discharges a first content filled in the first interior space, and the second pump module is inserted into the second interior space when the second container is inserted into the insertion space. The second pump module also discharges a second content filled in the second interior space.

12 Claims, 6 Drawing Sheets

(51) Int. Cl.
*B05B 11/10* (2023.01)
*B05B 11/02* (2023.01)

(52) U.S. Cl.
CPC ..... *B05B 11/1084* (2023.01); *B65D 81/325* (2013.01); *A45D 2200/056* (2013.01); *B05B 11/1074* (2023.01)

(58) Field of Classification Search
CPC ..... A45D 40/24; A45D 2200/056; A45D 2034/005; A45D 2200/055
See application file for complete search history.

(56) References Cited

U.S. PATENT DOCUMENTS

| | | | | | |
|---|---|---|---|---|---|
| 5,611,463 | A * | 3/1997 | Favre | B05B 11/028 222/137 |
| 5,656,035 | A * | 8/1997 | Avoy | B05B 1/26 141/2 |
| 9,192,949 | B2 * | 11/2015 | Lang | B05B 11/00442 |
| 11,034,503 | B1 * | 6/2021 | Lee | B05B 11/0054 |
| 2020/0307891 | A1 * | 10/2020 | Lee | A45D 34/00 |

FOREIGN PATENT DOCUMENTS

| | | | |
|---|---|---|---|
| KR | 10-2015-0063689 | A | 6/2015 |
| KR | 10-2018-0085253 | A | 7/2018 |
| KR | 10-1923306 | B1 | 11/2018 |
| KR | 10-1963619 | B1 | 3/2019 |
| WO | 2019/002742 | A1 | 1/2019 |

* cited by examiner

CONTAINER FOR DISCHARGING DIFFERENT TYPES OF CONTENT

CROSS-REFERENCE TO RELATED APPLICATIONS

This application is a National Phase Application of PCT International Application No. PCT/KR2019/017439, which was filed on Dec. 11, 2019, and which claims priority from Korean Patent Application No. 10-2019-0048812 filed on Apr. 26, 2019. The disclosures of the above patent applications are incorporated herein by reference in their entirety.

BACKGROUND

Technical Field

The present invention relates to a dispensing container for discharging different types of contents that allows the user to select a content for use.

Description of the Related Art

Dispensing containers are currently in use, where a dispensing container may hold two types of contents separately within a single container, with the contents mixed together when they are used. For example, in the field of cosmetic products, a dispensing container is being manufactured and distributed in which a gel type base and a powder are stored individually without mixing, with the base and the powder mixed together when applied. This form of dispensing container is mainly used in cases where a mixture of the two different types of contents provides a synergetic effect but where a premature mixing of the two different contents before the time of use causes the contents to spoil or exhibit a lowered performance after a prolonged period of distribution.

Korean Registered Patent No. 1923306 discloses a dispensing container capable of mixing heterogeneous substances. The dispensing container disclosed in the above prior art document includes two pumps and is structured such that the two types of contents are discharged by their respective pumps and mixed immediately before they are dispensed out of the container.

The conventional dispensing container for mixing heterogeneous substances having the structure above includes two different types of contents within the container, and the user does not have the option of selecting the type of content used.

SUMMARY OF THE INVENTION

Technical Problem

An aspect of the present invention, which was conceived to resolve the problem described above, is to provide a dispensing container for discharging different types of contents that allows the user to select a content.

Other objectives of the present invention will be more clearly understood from the embodiments set forth below.

Solution to Problem

A dispensing container according to an aspect of the present invention may include: a first container that includes an insertion space therein and a first interior space separated from the insertion space by a partition wall; a second container that is formed separately from the first container, is configured to be inserted into the insertion space, and includes a second interior space; a first pump module that is coupled to the first container and is configured to discharge a first content filled in the first interior space; and a second pump module that is coupled to the first container and is configured to be inserted into the second interior space, when the second container is inserted into the insertion space, to discharge a second content filled in the second interior space.

A container according to an embodiment of the present invention can include one or more of the following features. For example, the first pump module and the second pump module can have different one-time discharge amounts. Also, the first pump module can be formed with a stroke length greater than that of the second pump module.

A second lower cap can be coupled to a lower end of the second container, a container piston can be inserted within the second container, and the container piston can move upward according to a decrease in the amount of content filled in the second interior space.

The first pump module and the second pump module can be connected to a single nozzle tip, and the first content and the second content can be discharged through the nozzle tip.

The nozzle tip can include a pair of connection recesses formed respectively on both sides and a pair of discharge holes connecting with the connection recesses, and the dispensing container can further include nozzle hooks that are coupled respectively with the first pump module and the second pump module, where the nozzle hooks can be inserted into the connection recesses.

The first container can include a first lower cap coupled to a lower end thereof, and the first lower cap can include an insertion hole configured to receive the partition wall inserted therein.

A dispensing container according to another aspect of the present invention may include: a first container having two insertion spaces therein; two second containers that are formed separately from the first container, are configured to be inserted respectively into the insertion spaces, and each include an interior space; and two pump modules coupled to the first container, where the pump modules may be inserted into the second containers, when the second containers are inserted into the insertion spaces, to discharge contents.

Advantageous Effects of Invention

An embodiment of the present invention can provide a dispensing container for discharging different types of contents that allows the user to select and use various types of contents.

DETAILED DESCRIPTION OF THE INVENTION

Figure 1:
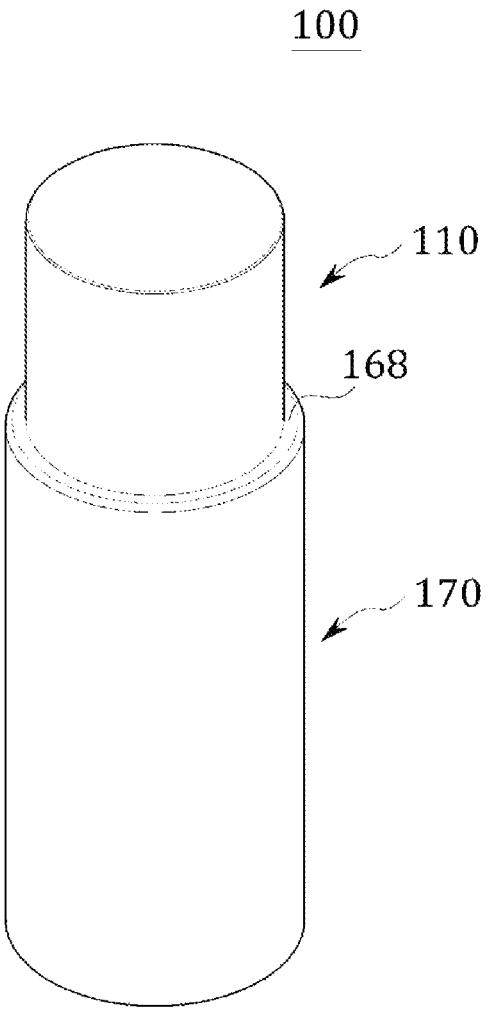
FIG. 1 illustrates a dispensing container according to a first disclosed embodiment of the present invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted, if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," "upper" and "lower," "inner" and "outer," etc., may be used to describe various components, such components must not be limited to the above terms. The above terms are used only to distinguish one component from another.

Certain embodiments of the invention will be described below in more detail with reference to the accompanying drawings. Those components that are the same or are in correspondence are rendered the same reference numeral, and redundant descriptions are omitted.

Figure 2:
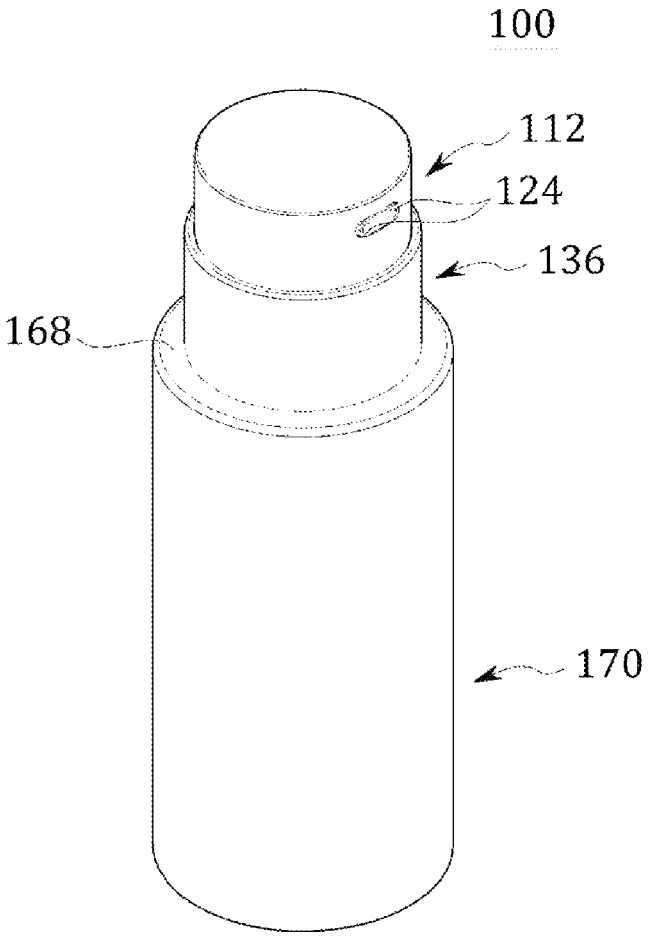
FIG. 2 illustrates the dispensing container of FIG. 1 with the over-cap separated.

FIG. 1 illustrates a dispensing container 100 according to a first disclosed embodiment of the present invention, and FIG. 2 illustrates the dispensing container 100 of FIG. 1 with the over-cap 110 separated.

Referring to FIG. 1 and FIG. 2, a dispensing container 100 according to this embodiment can have a generally cylindrical shape, with an over-cap 110 and a first container 170 forming the exterior. The over-cap 110 may be separably coupled to a periphery of the pump cover 136. Separating the over-cap 110 may expose a nozzle cap 112 and the pump cover 136. Also, there may be two discharge holes 124 formed in the periphery of the nozzle cap 112 and exposed to the outside, where a first content (not shown) and a second content (not shown) may be discharged to the outside through the respective discharge holes 124.

Figure 3:
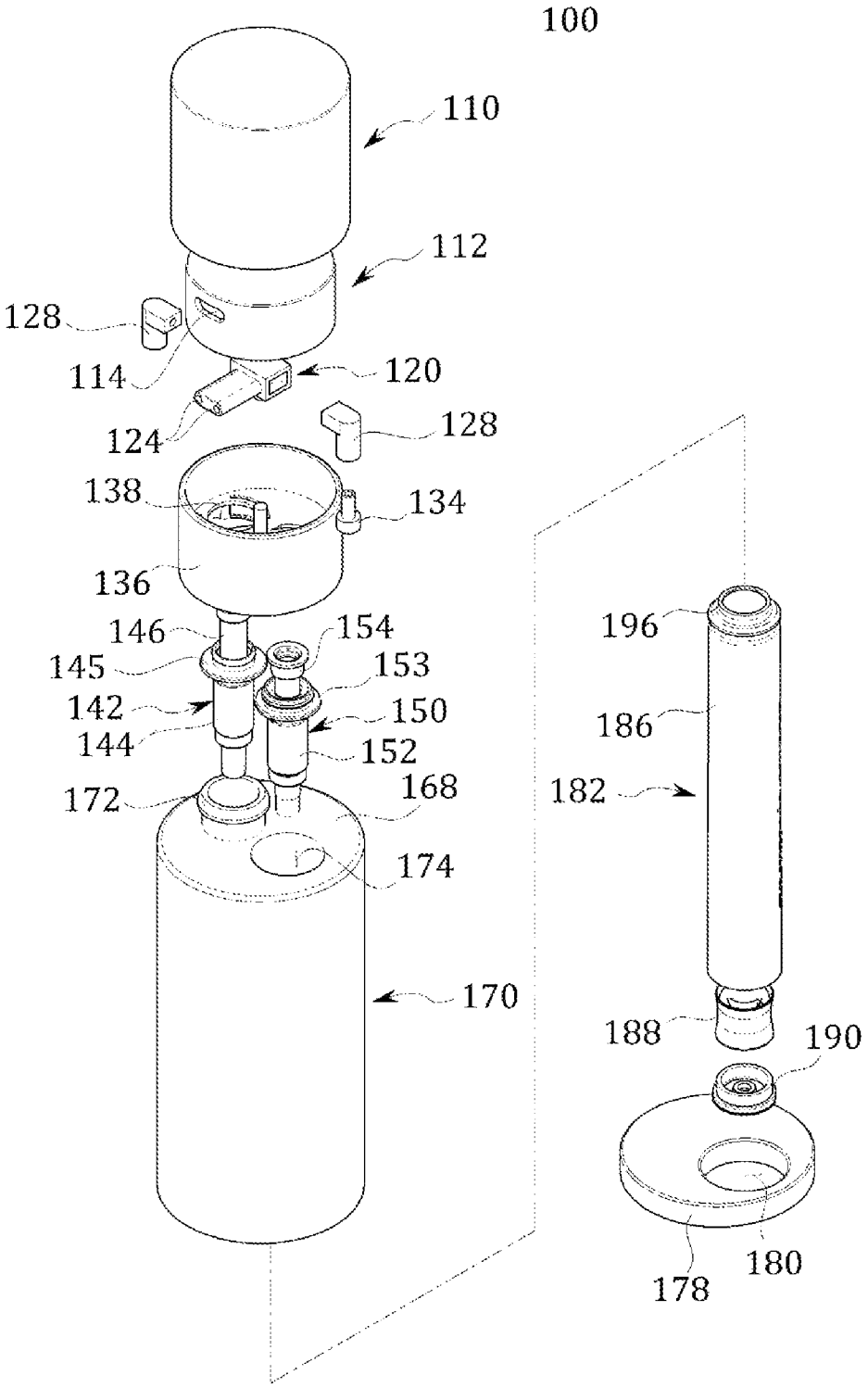
FIG. 3 illustrates the dispensing container of FIG. 1 in a disassembled state.

FIG. 3 illustrates the dispensing container 100 of FIG. 1 in a disassembled state. Also, FIG. 4 is a cross-sectional view of the dispensing container of FIG. 1, and FIG. 5 is a cross-sectional view of the dispensing container 100 of FIG. 4 with the second container 182 removed.

Figure 5:
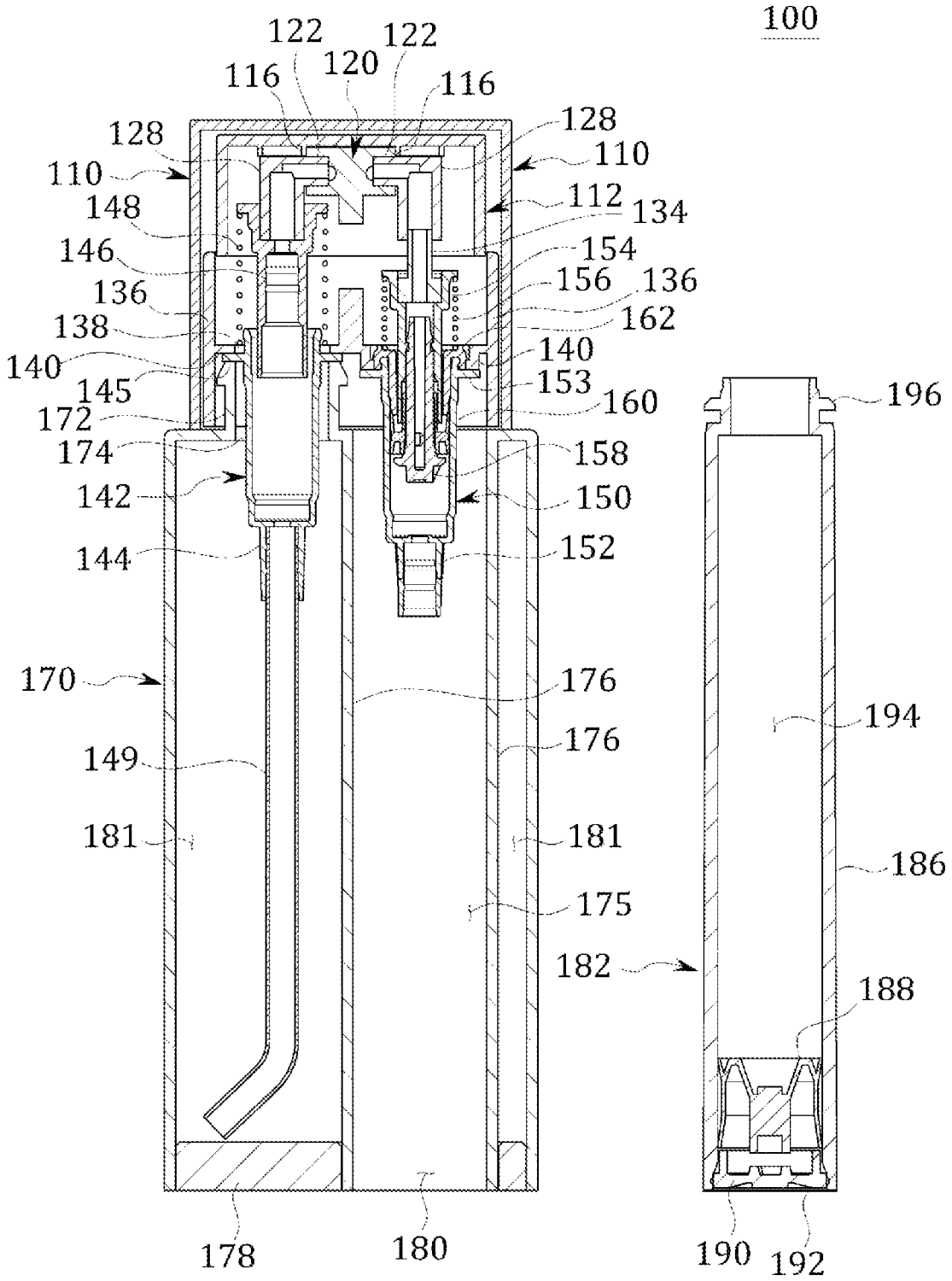
FIG. 5 is a cross-sectional view of the dispensing container of FIG. 4 with the second container removed.

Incidentally, a cap (not shown) may be coupled to an upper portion of the second container 182, but FIG. 3 and FIG. 5 illustrate the second container 182 with the cap removed.

Figure 4:
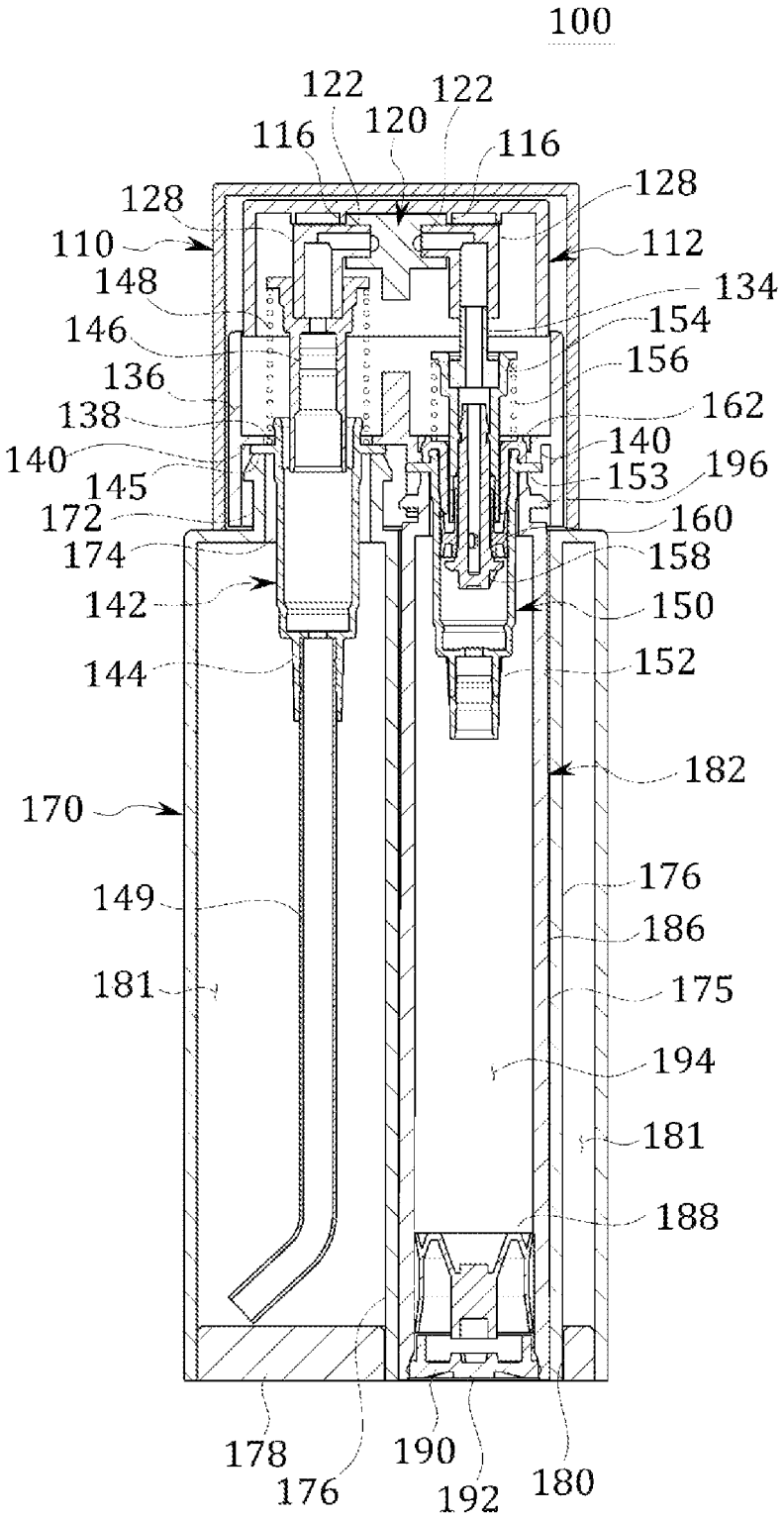
FIG. 4 is a cross-sectional view of the dispensing container of FIG. 1.

Referring to FIGS. 3 to 5, a dispensing container 100 according to the first disclosed embodiment may be characterized by individually fabricating a first container 170, in which to fill a first content (not shown), and a second container 182, in which to fill a second content (not shown), and inserting the second container 182 into the first container 170 for use. The first container 170 may couple with a first pump module 142 to dispense the first content, and the second container 182 may couple with a second pump module 150 to dispense the second content.

Thus, a dispensing container 100 based on this embodiment can enable the user to selectively couple one of multiple second containers 182, which may be filled with second contents of various types, onto the first container 170. As the user can select any one of a variety of second content types, the user can be offered a greater scope of selection.

A dispensing container 100 according to the first disclosed embodiment may include a first container 170 and second container 182, a first pump module 142 and second pump module 150 that are coupled to an upper portion of the first container 170 to pump and discharge different contents, a pump cover 136 and nozzle cap 112 that are coupled to an upper portion of the first container 170, and a first lower cap 178 that is coupled to a lower portion of the first container 170. Also, nozzle hooks 128, a nozzle tip 120, and a nozzle guide 134 may be included, which may form the passageway through which the contents discharged by the first pump module 142 and second pump module 150 may pass.

The first container 170 may have a cylindrical shape and may include therein a first interior space 181, in which the first content may be filled, and an insertion space 175, into which the second container 182 may be inserted. The first interior space 181 and the insertion space 175 may be separated by a partition wall 176.

The partition wall 176 may not be exposed to the outside of the first container 170 and may be positioned within the first interior space 181 only. The partition wall 176 can be formed such that its length extends from the upper surface 168 to the lower end of the first container 170. Also, the partition wall 176 can have the shape of a hollow cylinder with its upper end and lower end open. The open upper end of the partition wall 176 may form a coupling hole 174 in the upper surface 168 of the first container 170. The coupling hole 174 may be formed eccentrically and not in the center of the circular upper surface 168. Also, the partition wall 176 may form the insertion space 175 into which the second container 182 can be inserted.

The partition wall 176 may be formed such that its internal shape corresponds to the exterior of the second container 182. As the second container 182 according to this embodiment is illustrated as having a cylindrical shape, the partition wall 176 may also have the shape of a hollow cylinder. Of course, the present invention is not limited by the shape of the second container 182. Thus, in a dispensing container according to another embodiment of the present invention, the second container can have an oval or a polygonal horizontal cross section and can have changes in the size and shape of the horizontal cross section along its height.

The insertion space 175 may correspond to an empty space in which to insert the second container 182. The insertion space 175 can be formed with an inner diameter that allows the second container 182 to be easily inserted but does not allow the second container 182 to be easily detached once the second container 182 is inserted.

In the interior of the first container 170, the remaining space other than the volume formed by the partition wall 176 may correspond to the first interior space 181 for filling the first content. The first interior space 181 may be completely separated from the second interior space 194 (which is filled with the second content) by the partition wall 176 and the container body 186 of the second container 182. Also, the first interior space 181 may be formed with a greater volume than that of the second interior space 194.

On the upper surface 168 of the first container 170, a head 172 may be formed protruding to a particular height. The head 172 may have a circular horizontal cross section and may receive the first pump module 142 inserted within. The head 172 may be formed higher than the head 196 formed on the upper end of the second container 182. As a result, the first pump module 142 positioned on the head 172 of the first container 170 may be positioned higher than the second pump module 150 positioned on the head 196 of the second container 182. Also, the stroke length of the first pump module 142 may be formed greater than that of the second pump module 150. Thus, even when the first pump module 142 and the second pump module 150 are pressed with the same force, the discharge amount of the first pump module 142 may be greater than that of the second pump module 150.

The coupling hole 174 may be formed in the upper surface 168 of the first container 170. The second pump module 150 and the upper end of the second container 182 may be inserted through the coupling hole 174. The second pump module 150 may be inserted within the second container 182.

The lower end of the first container 170 may have an open structure and may be covered by the first lower cap 178. The first lower cap 178 may have a disc-like shape and may seal the lower end of the first container 170. An insertion hole 180 may be formed in the first lower cap 178. The second container 182 can be inserted through the insertion hole 180 into the insertion space 175 formed within the first container 170. Referring to FIG. 3, when the second container 182 is inserted into the insertion space 175, the lower end of the second container 182 may be positioned at the insertion hole 180.

The dispensing container 100 can be fabricated and distributed with the first container 170 filled by a first content but without the second container 182 inserted. The user can select any one of various second containers 182 filled by various types of second contents and insert the selected second container 182 within the first container 170 for use.

While the illustrations depict a dispensing container 100 according to this embodiment as including a first container 170 that has a circular horizontal cross section, the present invention is not limited by the shape and size of the first container 170. Thus, a dispensing container 100 according to another embodiment of the present invention can have a horizontal cross section shaped as a polygon, an oval, etc.

The second container 182 may have the shape of a hollow cylinder and may have a second interior space 194 formed therein for holding a second content. The second container 182 may be inserted into the insertion space 175 formed within the first container 170, during the process of which the second pump module 150 may be inserted within the second container 182. The second container 182 may include a head 196, a container body 186, a container piston 188, and a second lower cap 190.

The container body 186 may be shaped as a hollow cylinder, with the lower end open and the head 196 formed on the upper end. The container body 186 can be formed with a length that is the same as the length of the first container 170 and a diameter that is smaller than that of the first container 170. The container piston 188 and the second lower cap 190 may be coupled to the lower end of the container body 186.

The head 196 may be formed at the upper end of the container body 186 with a height that is lower compared to the head 172 of the first container 170. The upper end of the head 196 may contact the lower surface of a flange 153 formed on the periphery of the second housing 152 of the second pump module 150. When the second container 182 is inserted into the insertion space 175, the insertion of the second container 182 may be completed when the head 172 comes into contact with the flange 153.

A cap, which is not illustrated in the drawings, can be coupled to the head 196, where the cap can be removed by the user before the second container 182 is inserted into the insertion space 175.

The container body 186 may have the structure of a hollow cylinder. The upper portion of the container body 186 may be open by way of the head 196, while the lower portion may be closed off by the container piston 188. Also, the lower end of the container body 186 may be covered by the second lower cap 190. The inside of the container body 186 may be filled with a second content (not shown). The second content can be dispensed by the second pump module 150 to the outside of the dispensing container 100.

The container piston 188 may be inserted at the lower portion of the container body 186 such that the container piston 188 is movable within the container body 186. The outer perimeter of the container piston 188 may be in tight contact against the inner perimeter of the container body 186 to block any entry of air into the second interior space 194. Also, when the remaining amount of the second content filled in the second interior space 194 is decreased due to use of the second content, the container piston 188 may be moved upward by the reduction in pressure within the second interior space 194, to thereby push the second content upward.

Below the container piston 188, the second lower cap 190 may be coupled in a fixed manner. The second lower cap 190 may include a through-hole (not shown), so that the pressure outside the dispensing container 100 (i.e., atmospheric pressure) may be applied on the container piston 188 through the through-hole. Thus, as the pressure within the second interior space 194 is gradually decreased due to use of the second content, the container piston 188 may gradually be moved up by the atmospheric pressure towards the upper portion of second interior space 194.

A detachable film 192 can be attached to the lower surface of the second lower cap 190. The though-hole formed in the second lower cap 190 can be closed off by the detachable film 192. The user can open the though-hole formed in the second lower cap by removing the detachable film 192 immediately before or immediately after inserting the second container 182 into the insertion space 175.

The first pump module 142 may be coupled to the upper surface 168 of the first container 170 and may be positioned adjacent to the second pump module 150. The first pump module 142 may have a portion thereof inserted within the first container 170 to dispense the first content to the outside.

The first pump module 142 may include a first housing 144, a first valve 146, a first spring 148, and a first pump nozzle 149. As the composition of the first pump module 142 corresponds to commonly known technology, such as from the disclosure of Korean Registered Patent No. 1963619, etc., details of the first pump module 142 are omitted. Moreover, the present invention is not limited by the composition of the first pump module 142. Thus, a first pump module according to another embodiment of the present invention can have any of a variety of forms and structures, including those of the pump module disclosed in the registered patent mentioned above.

A nozzle hook 128 may be inserted onto the upper end of the first valve 146. When the nozzle cap 112 is pressed downward, the first content drawn into the first valve 146 may flow through the nozzle hook 128 to the nozzle tip 120 and may subsequently be discharged out of the dispensing container 100.

The nozzle hook 128 may be shaped as an inverted "L" and may have a through-hole formed within. Thus, the nozzle hook 128 may provide a passageway through which the first content that has been discharged through the first pump module 142 can move to the nozzle tip 120.

The first pump module 142 can dispense a greater amount of content in a one-time dispensing compared to the on-time dispensing amount of the second pump module 150. A dispensing container 100 based on this embodiment is illustrated as having a first container 170 that is larger in volume compared to the second container 182, and as such, the one-time dispensing amount of the first content can be greater than that of the second content. Thus, ratio of the one-time dispensing amount of the second pump module 150 to the one-time dispensing amount of the first pump module 142 can be determined according to the ratio of the injected amount of the second content to the injected amount of the first content. Such structure of the pump modules can synchronize the time points at which the first content and the second content are completely used up.

The second pump module 150 may be coupled to the upper surface 168 of the first container 170 and may be positioned adjacent to the first pump module 142. The second pump module 150 may be inserted into the second container 182 to discharge the second content.

The second pump module 150 may include a second housing 152, a second valve 154, a second spring 156, a guide 158, a pump piston 160, and a housing head 162. As the composition of the second pump module 150 corresponds to commonly known technology, such as from the disclosure of Korean Registered Patent No. 1963619, etc., details of the second pump module 150 are omitted. Moreover, the present invention is not limited by the composition of the second pump module 150. Thus, a second pump module according to another embodiment of the present invention can have any of a variety of forms and structures other than those of the pump module disclosed in the registered patent mentioned above.

A nozzle guide 134 may be inserted onto the upper end of the second valve 154. The nozzle guide 134 may be connected to a nozzle hook 128. When the nozzle cap 112 is pressed downward, the second content drawn into the second valve 154 may flow through the nozzle guide 134 and the nozzle hook 128 to the nozzle tip 120 and may subsequently be discharged out of the dispensing container 100.

The nozzle guide 134 may serve to connect the second pump module 150, which may be positioned lower than the first pump module 142, with the nozzle hook 128. Thus, the nozzle guide 134 can be omitted at the first pump module 142.

The nozzle tip 120 may be connected to the two nozzle hooks 128 to provide passageways for discharging the first content and second content. Connection recesses 122 may be formed in the left and right sides of the nozzle tip 120, where the nozzle hooks 128 may be inserted into the connection recesses 122. In the front of the nozzle tip 120, there may be formed two discharge holes 124. The first content and second content flowed through their respective nozzle hooks 128 may move through the respective discharge holes 124 and be discharged out of the dispensing container 100. The front end of the nozzle tip 120 may be inserted through a through-hole 114 formed in the nozzle cap 112.

The portion of the nozzle tip 120 in the sides of which the connection recesses 122 are formed may be inserted between pressing protrusions 116 formed on the inner surface of the nozzle cap 112. As a result, even when the nozzle cap 112 is moved, the position of the nozzle tip 120 with respect to the nozzle cap 112 may remain unchanged.

The pump cover 136 may couple the first pump module 142 and second pump module 150 with the first container 170. That is, the pump cover 136 may be positioned over the first container 170 and may include two coupling holes 138 through which the first pump module 142 and second pump module 150 may be inserted. The pump cover 136 may also include a pushing protrusion 140 on the inside to downwardly press the first pump module 142 and second pump module 150 and thereby secure the positions of the first pump module 142 and second pump module 150.

The top and bottom of the pump cover 136 may be open. A planar member (no numeral assigned) that separates the upper and lower portions may be formed on the inside of the pump cover 136, and the two coupling holes 138 may be formed in the planar member.

The nozzle cap 112 may correspond to the part that is pressed down by the user for dispensing the contents. The nozzle cap 112 may have the shape of a hollow cylinder of which the top is closed and the bottom is open. The nozzle cap 112 may be pressed by the user to move downward while being inserted through the open top of the pump cover 136. As the nozzle cap 112 is thus moved down, the first pump module 142 and second pump module 150 may be pressed downward, and the first content and second content may be dispensed simultaneously.

A through-hole 114 may be formed in the periphery of the nozzle cap 112, and the end portion of the nozzle tip 120 may be inserted through the through-hole 114 to be exposed to the outside. Also, on the closed top of the nozzle cap 112, pressing protrusions 116 may protrude downward towards the inside. The nozzle tip 120 can be inserted in-between a pair of pressing protrusions 116 by way of an interference fit.

When the external force pressing down on the nozzle cap 112 is subsequently removed, the nozzle cap 112 may be moved back up by the springs 148, 156 of the first pump module 142 and the second pump module 150 and may thus return to its original position.

The dispensing container 100 can be fabricated and distributed individually with only the first content filled in the first interior space 181 and without the second container 182 inserted in the insertion space 175. The user can then select one of multiple second containers 182 containing various types of second contents that can be mixed with the first content for use.

For a second container 182 selected by the user, the user may remove the cover (not shown) coupled to the upper portion, remove the detachable film 192 coupled to the lower portion, and then insert the second container 182 into the insertion space 175 formed within the first container 170. During the insertion of the second container 182 into the insertion space 175, the second pump module 150 may be inserted through the open entrance of the second container 182 into the inside of the second container 182. This may enable the second pump module 150 to dispense the second content filled within the second container 182.

When the user presses down on the nozzle cap 112 to dispense the contents, the first pump module 142 and the second pump module 150 may be pressed down simultaneously, so that the first content and the second content may be discharged simultaneously. The first content and second content can be discharged respectively through the discharge holes 124 of the nozzle tip 120 to be mixed together outside the dispensing container 100.

A dispensing container according to another embodiment of the present invention can be structured such that the first and second contents are mixed together within the container by the operation of the pump modules and then discharged, instead of being mixed outside.

Thus, a dispensing container 100 based on this embodiment allows the user to select a second content and then use the selected second content together with the first content, thereby allowing a greater variety of combinations and providing the user with a wider scope of selection. The dispensing container 100 is also convenient to use, as the user may simply insert the second container 182 into the first container 170.

Figure 6:
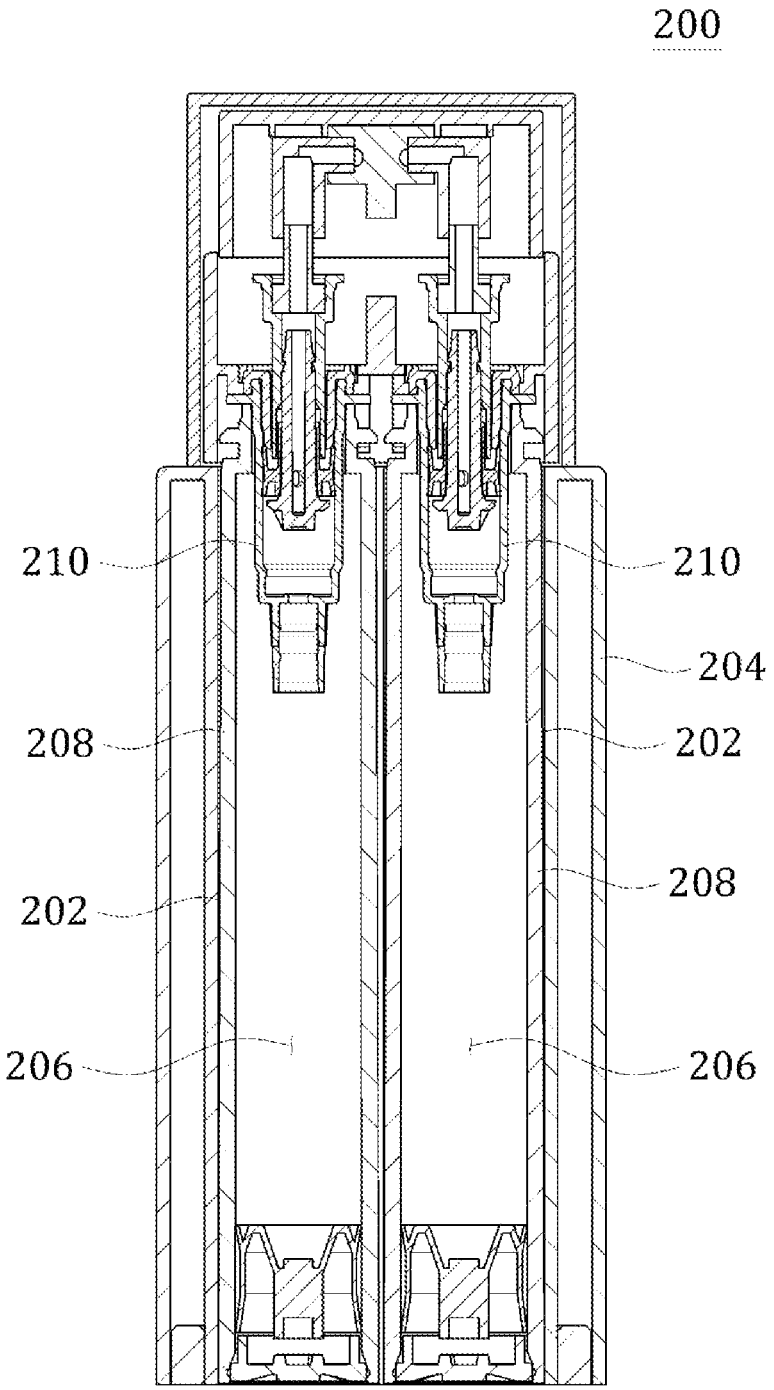
FIG. 6 is a cross-sectional view of a dispensing container according to a second disclosed embodiment of the present invention.

FIG. 6 is a cross-sectional view of a dispensing container 200 according to a second disclosed embodiment of the present invention.

Referring to FIG. 6, in a dispensing container 200 according to the second disclosed embodiment, the second container 182 and second pump module 150 of the first disclosed embodiment may be included in pairs in left-right symmetry. That is, a dispensing container 200 according to the second disclosed embodiment may include a first container 204, which may include two insertion spaces 202 therein, and two second containers 208, which may be formed independently from the first container 204 and inserted into the insertion spaces 202 and which may each include an interior space 206. A dispensing container 200 according to the second disclosed embodiment may also include two pump modules 210. When the second containers 208 are inserted respectively into the insertion spaces 202, the pump modules 210 can be inserted through the open entrances of the respective second containers 208 to discharge the different contents filled in the two second containers 208.

The second containers 208 and pump modules 210 in a dispensing container 200 based on the second disclosed embodiment may be substantially the same as the second container 182 and second pump module 150 of a dispensing container 100 based on the first disclosed embodiment and, as such, are not described here in further detail.

The first container 204 in a dispensing container 200 based on the second disclosed embodiment may have just the partition wall formed therein for forming the two insertion spaces 202 and may not include a separate space for holding a content. The contents may be filled in the two second containers 208.

The first container 204 can have a cross section that is not circular, such as an oval or a polygonal shape.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A dispensing container for discharging different types of contents, the dispensing container comprising:

a first container comprising an insertion space therein and a first interior space separated from the insertion space by a partition wall;

a second container formed separately from the first container, the second container being configured to be inserted into the insertion space and comprising a second interior space;

a first pump module coupled to the first container and configured to discharge a first content filled in the first interior space; and a second pump module coupled to the second container, the second pump module being configured to be inserted into the second interior space when the second container is inserted into the insertion space, the second pump module being configured to discharge a second content filled in the second interior space, wherein a first lower cap is coupled to a lower end of the second container, a container piston is inserted within the second container, and the container piston moves upward according to a decrease in an amount of the second content filled in the second interior space.

2. The dispensing container of claim 1, wherein the first container comprises a second lower cap coupled to a lower end thereof, and the second lower cap comprises an insertion hole configured to receive the second container.

3. The dispensing container of claim 1, wherein the first pump module and the second pump module have different one-time discharge amounts.

4. The dispensing container of claim 3, wherein a stroke length of the first pump module is formed greater than a stroke length of the second pump module.

5. The dispensing container of claim 1, wherein the first pump module and the second pump module are connected to a single nozzle tip, and the first content and the second content are discharged through the nozzle tip.

6. The dispensing container of claim 5, wherein the nozzle tip comprises a pair of connection recesses formed respectively on both sides and a pair of discharge holes connecting with the connection recesses, the dispensing container further includes nozzle hooks coupled respectively with the first pump module and the second pump module, and the nozzle hooks are inserted into the connection recesses.

7. A dispensing container for discharging different types of contents, the dispensing container comprising:

a first container comprising two insertion spaces therein;

two second containers formed separately from the first container, the second containers being configured to be inserted respectively into the insertion spaces and each comprising an interior space; and two pump modules coupled to the first container, wherein the pump modules are configured to be inserted into the second containers when the second containers are inserted into the insertion spaces, the pump modules being configured to discharge a content filled in the interior space of each second container, wherein a first lower cap is coupled to a lower end of each second container, a container piston is inserted within each second container, and the container piston moves upward according to a decrease in an amount of the content filled in the interior space, wherein the first container comprises a second lower cap coupled to a lower end thereof, and the second lower cap comprises two insertion holes to receive the two second containers, respectively.

8. A dispensing container for discharging different types of contents, the dispensing container comprising:

a first container comprising an insertion space therein and a first interior space separated from the insertion space by a partition wall;

a second container formed separately from the first container, the second container being configured to be inserted into the insertion space and comprising a second interior space;

a first pump module coupled to the first container and configured to discharge a first content filled in the first interior space; and a second pump module coupled to the second container, the second pump module being configured to be inserted into the second interior space when the second container is inserted into the insertion space, the second pump module being configured to discharge a second content filled in the second interior space, wherein the first container comprises a first lower cap coupled to a lower end thereof, and the first lower cap comprises an insertion hole configured to receive the second container.

9. The dispensing container of claim 8, wherein the first pump module and the second pump module have different one-time discharge amounts.

10. The dispensing container of claim 9, wherein a stroke length of the first pump module is formed greater than a stroke length of the second pump module.

11. The dispensing container of claim 8, wherein the first pump module and the second pump module are connected to a single nozzle tip, and the first content and the second content are discharged through the nozzle tip.

12. The dispensing container of claim 11, wherein the nozzle tip comprises a pair of connection recesses formed respectively on both sides and a pair of discharge holes connecting with the connection recesses, the dispensing container further includes nozzle hooks coupled respectively with the first pump module and the second pump module, and the nozzle hooks are inserted into the connection recesses.

* * * * *